United States Patent [19]

Takano

[11] Patent Number: 4,579,697

[45] Date of Patent: Apr. 1, 1986

[54] METHOD FOR PACKING CONCRETE CEMENT UTILIZING A VIBRATOR

[76] Inventor: Kikumitsu Takano, 53-3, Oshiage 3-chome, Sumida-ku, Tokyo, Japan, 131

[21] Appl. No.: 631,198

[22] Filed: Jul. 16, 1984

[30] Foreign Application Priority Data

Aug. 22, 1983 [JP] Japan ..... 58-152860

[51] Int. Cl.[4] ..... B28B 1/08

[52] U.S. Cl. ..... 264/40.1; 264/69; 264/72

[58] Field of Search ..... 264/40.1, 69, 72

[56] References Cited

U.S. PATENT DOCUMENTS 2,507,302 5/1950 Giertz-Hedstrom ..... 264/69

2,667,679 2/1954 Jackman ..... 264/69 X 3,042,594 7/1962 Hauth ..... 264/72 X 3,470,279 9/1969 Abbott ..... 264/72

4,079,109 3/1978 Helmrich et al. ..... 264/72

FOREIGN PATENT DOCUMENTS 0833441 5/1981 U.S.S.R. ..... 264/69

*Primary Examiner*—Jan Silbaugh

*Attorney, Agent, or Firm*—Cushman, Darby & Cushman

[57] ABSTRACT

A method and apparatus for curing concrete cement by packing the concrete with aid of a vibrator having a variable vibration speed. The vibration speed is selected according to the viscosity of the cement, as is the time period. The disclosed method and apparatus causes the cement to be uniformly settled and distributed throughout the objective space field.

3 Claims, 15 Drawing Figures

METHOD FOR PACKING CONCRETE CEMENT UTILIZING A VIBRATOR

FIELD OF THE INVENTION

This invention relates to a method and apparatus for curing concrete cement by packing or settling the cement with a vibrator.

BACKGROUND OF THE INVENTION

Conventionally, when a concrete paving operation is accomplished, a vibrator is employed for providing a vibration to the cement in order to smooth the cement through the site field to pack or tighten it. The present invention improves this process by selecting the vibration speed in accordance with the characteristics of the cement and slab particle sizes.

In accordance with the present invention, for example, a vibration speed of 1,500 vpm (vibrations per minute) and 9,000 vpm, for rough particle slab structures and for cement and finely divided particle structures, respectively, may be used. This vibration method eliminates any air gap or gaps in the concrete cement interior, and provides increased strength and esthetic beauty for the finished concrete cement.

Known conventional vibrators use a given balance weight attached about a rotary shaft of a motor with the motor driven in a given rotary direction, thus establishing a single given speed, force and bandwidth (or time period) of the vibration. With a unitary vibration, as is used in the prior art, sands and stones comprising the concrete cement become separated in accordance with the weight of the various particles.

Known vibrators frequently insert a rod type vibration member into the concrete cement, but recent building requirements dictate anti-vibration construction techniques which utilize a high distribution of iron rod members in the concrete. This makes it difficult to insert the rod vibrator member into the concrete as required by the conventional vibrators.

Furthermore, pouring and curing of concrete is a time-critical process. Hence, the concrete should be quickly poured with a concrete mixer pump vehicle. Thus, many workers are required for pouring and curing jobs, thereby requiring much manpower to operate numerous vibrators.

Known vibrators are usually heavy in weight yet supported by a wooden frame. Consequently, failure of the wooden frames is a common problem.

To overcome at least these cited drawbacks of the prior art, in addition to others, this invention provides a method and apparatus for curing concrete cement with continuous paving from pouring to curing, by giving suitable vibrations at suitable times, all within a short time period.

BRIEF DESCRIPTION OF THE ACCOMPANYING DRAWINGS

These as well as other features and advantages of this invention may be better understood by reading the following detailed description of the presently preferred exemplary embodiment and the accompanying drawings, in which.

DESCRIPTION OF THE PREFERRED EMBODIMENT

Figure 1:
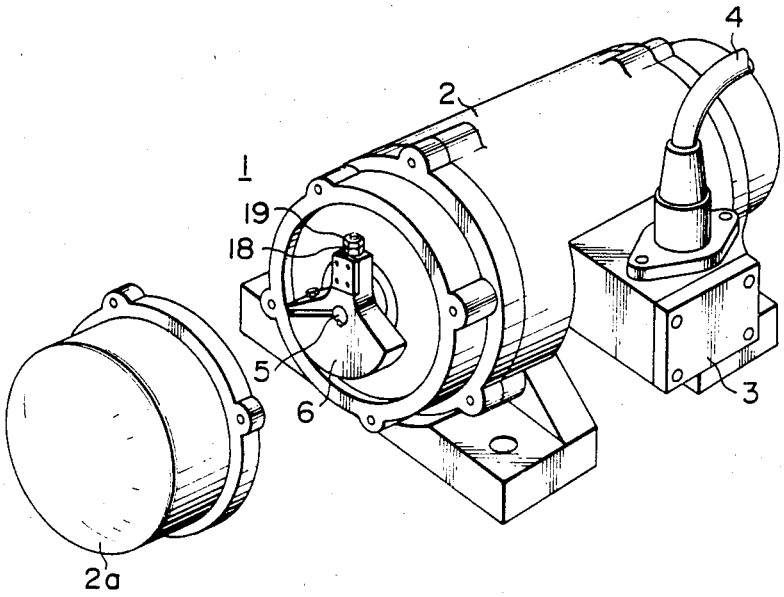
FIG. 1 is a perspective view of a vibrator in accordance with the present invention.
Figure 2:
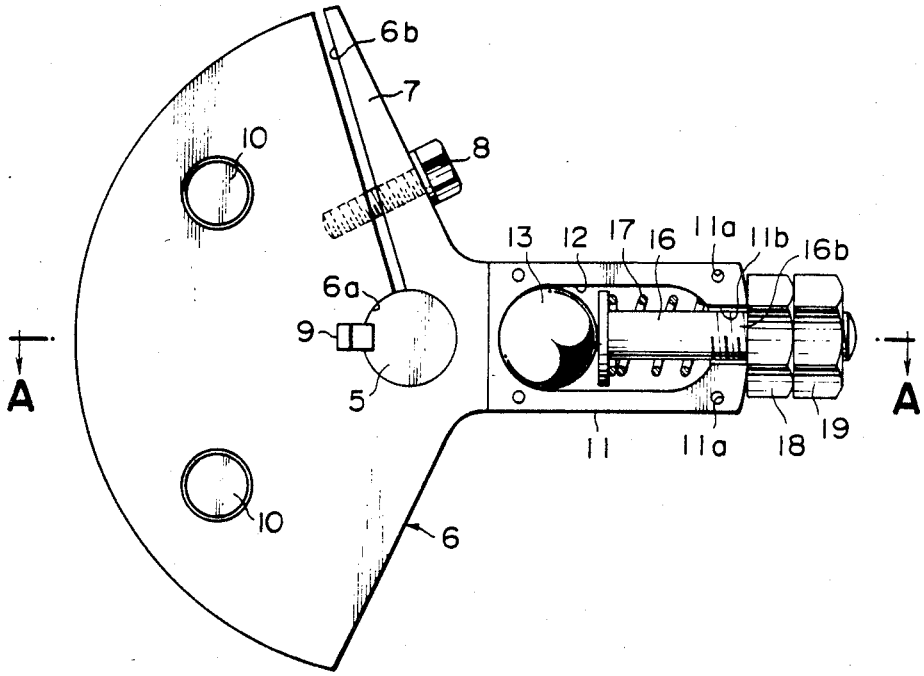
FIG. 2 is a front view of a weight transfer device in accordance with the present invention.

The vibrator employed in this invention will now be discussed with reference to FIGS. 1–5. The vibrator 1 may comprise an electric motor 2 as its basic element. Provided at a side of this motor 2 may be a terminal box 3 through which a power supply cord 4 is connected to the motor 2. A cover plate 2*a* may also be provided. Provided about an output shaft 5 of the motor 2 is a balance weight member 6 which is generally sectorial and made of iron or steel or the like. Provided on one side (either left or right) of the weight member 6 is a slit 6*b* which reaches through to mating hole 6*a* of the output shaft 5. A portion of member 6 adjacent slit 6*b* forms a resilient piece 7. Insertion of threadable bolt 8 from outside toward the weight member 6 causes the weight member 6 to be squeezed about the output shaft 5 and be fixed thereby with respect to the shaft. Wedged between the weight member 6 and the output shaft 5 may be a key 9, and provided on a side of the weight member 6 may be two weight change bolts 10. These detachable bolts modify the vibrator for 50 cycle or 60 cycle power areas by adjusting the rotary speed of the motor 2, which motor speed changes due to changing cycles.

Projection 11 is provided along an axial line of the weight member 6. It has a polygonal cylinder side, and the output shaft 5 is fixed at its base portion. A steel ball 13 may be slidably and rotatably mated in a hollow chamber 12 formed in the projection 11, said ball being in close proximity to the output shaft 5. The hollow chamber 12 has one opening side, clearly shown in FIGS. 2 and 3, which is closed by a closure plate 14 with a screw 15 through threadable holes 11*a*.

Figure 5:
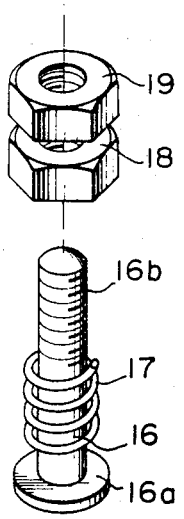
FIG. 5 is a perspective view showing a slidable shaft and nuts associated with the device of FIG. 2.

Formed at an outer end of the projection 11 is a notch 11*b* through which the slidable shaft 16 is slidably mated. The slidable shaft 16 is at one end inserted in the hollow chamber 12 as shown in FIG. 5, and its inserted side has a disk 16*a* fixed thereto. Provided resiliently between the disk 16*a* and the side of the notch 11*b* of the chamber 12 is a spring 17 which urges the slidable shaft 16 toward the steel ball 13.

Figure 3:
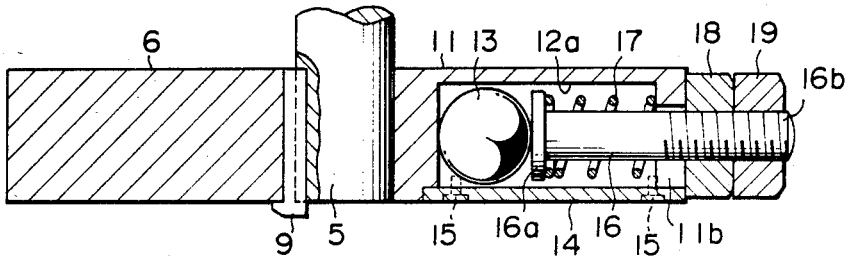
FIG. 3 is a cross section along line A—A of FIG. 2.
Figure 4:
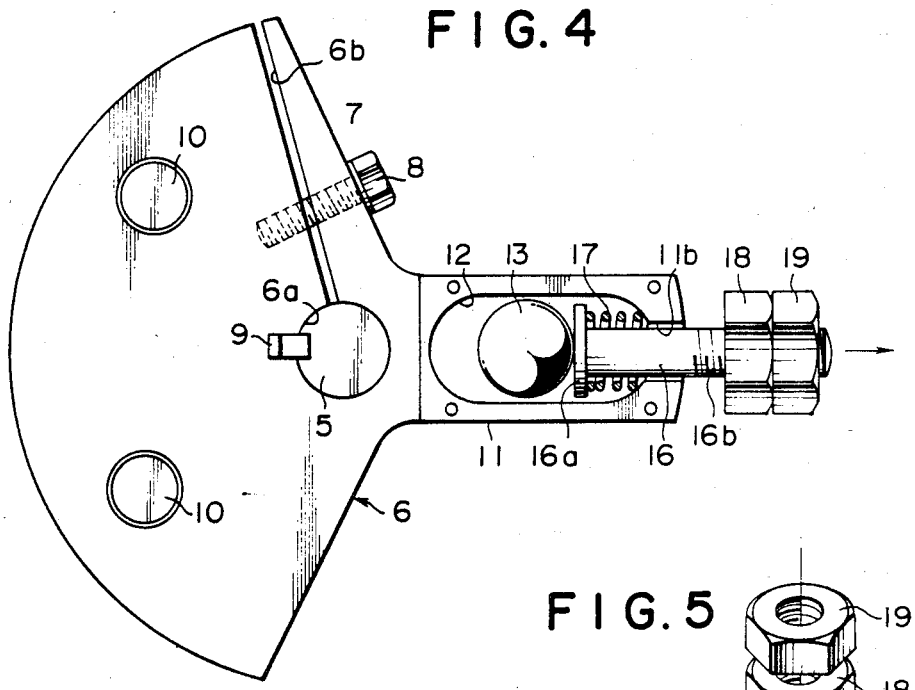
FIG. 4 is a view showing a state of motion of the device of FIG. 2.

An outer end of the shaft 16 passes through the notch 11*b* toward the outer side, and a male thread 16*b* is formed thereon (see FIG. 3). Two nuts 18 and 19 are mated about the male thread 16*b*. An adjustment of these nuts 18 and 19 causes spring 17 to shorten or lengthen, which adjusts the pressing force on the ball 13 by the shaft 16.

A conventional inverter (not shown) may be provided at the power side of the motor to adjust or control frequencies of current to be supplied to the motor 2. It readily changes the frequencies of the current to be supplied to the motor 2 within a certain range. This vibrator control will be discussed in further detail.

When electric current is not supplied to the motor 2, the slidable shaft 16 presses, via disk 16*a* against the ball 13 by a repulsive force of the spring 17, toward the end of the side of chamber 12 located closer to the output shaft 5. When the current is supplied to the motor 2 with a given frequency, the motor 2 is rotatably driven at a given speed. Due to the revolution of the motor, a centrifugal force is created and the ball 13 moves away from the output shaft to a site within the chamber 12 (see FIG. 4).

As a result of the centrifugal force, the slidable shaft 16 is pushed out thereby compressing the spring 17. The extent to which slidable shaft 16 is pushed out is related to the degree of the centrifugal force present. The movement of the shaft is not only caused by the centrifugal force acting on the mass of the ball 13, but also by the force acting on the mass of the shaft 16 and mass of the nuts 18 and 19. As a result, the inertia movement of the whole weight 6 changes, and the vibration speed of the vibrator is thereby determined.

Accordingly, as the frequency of the current to the motor 2 is changed, vibration speed of the vibrator can be desirably controlled. The inertia movement may also be greatly changed by manipulation of the nuts 18 and 19.

Thus, features of the present invention may include changing the current frequency to the motor and changing motor speed. Furthermore, the present invention employs a movable weight which is moved by a changing centrifugal force, this force changing with the changing speed of the motor. Adjustable position nuts 18 and 19 are present on the vibrating shaft. This arrangement permits control of the vibration speed of the vibrator.

A method for curing concrete cement employing this vibrator will now be described.

Figure 8:
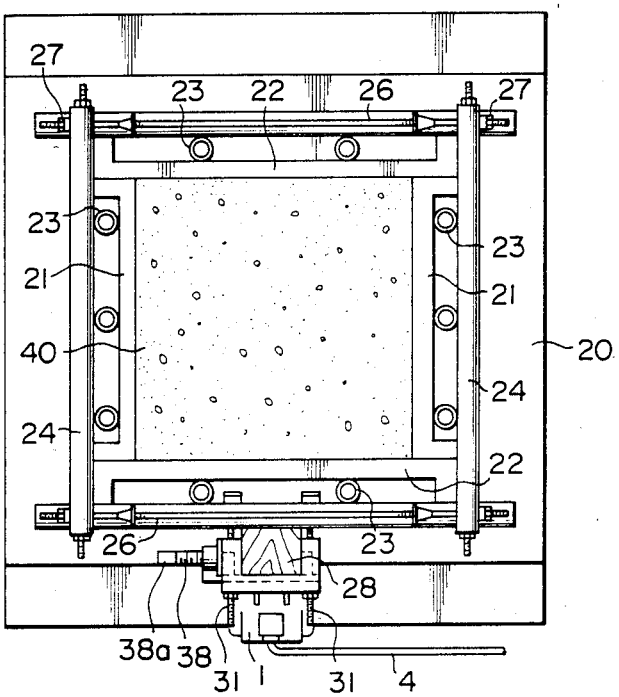
FIG. 8 is a plan view showing the arrangement of FIG. 6.

FIGS. 6–12 illustrate the method in detailed embodiments, wherein a base 20 has a pair of wooden frames 21 (as shown in FIG. 8) facing each other, and another pair of frames 22 which sandwich the pair of frames 21. This arrangement of two pairs of frames defines a polygonal space. Pipes 23 are provided at the outside of each of frames 21 and 22 at right angles, each pipe 23 having a pair of supporting pipes 24.

These supporting pipes 24 are arranged in pairs with an interconnecting fixture 25, and a plurality of such pairs are positioned up and down the structure. These pipes 24 sandwich the frames 21 and 22 respectively. Suspended between the fixtures 25 is an interconnecting rod 26 which has at both of its ends male threads on which a nut 27 is mated from the outside, so that each pair comprising the supporting pipes 24 are secured within the frames 21 and 22.

Figure 9:
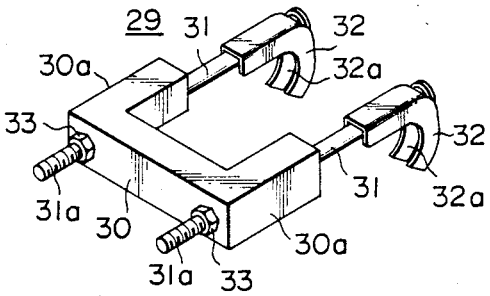
FIG. 9 is a perspective view of a metal fixture device.
Figure 10:
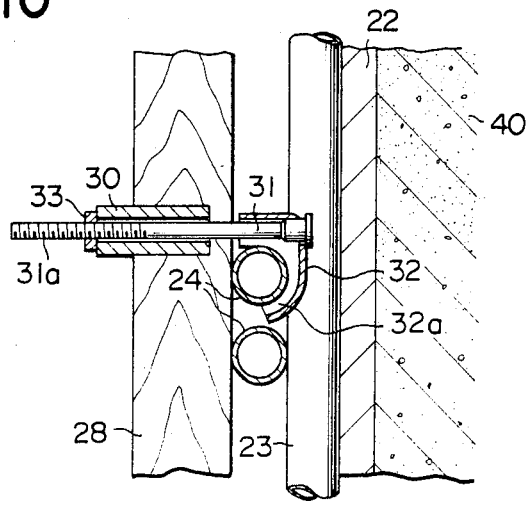
FIG. 10 is a view showing an arm rod attached.

A wooden pillar 28 is fixed along the frames in a vertical direction. A supporting metal fixture 29 has a generally U-shaped supporting frame 30 (as shown in FIG. 9) which has arms 30*a*, to which each shaft 31 is slidably and frictionally mated. Each shaft 31 has a male thread at a side of the frame 30 and a hook 32 which is fixed at the other end. Each hook 32 has an arcuate portion 32*a* which is hooked on one of the supporting pipes 24. Positioned between the pipe 24 and the frame 30 is the pillar 28, with the nut 33 mated on the male thread of the shaft 31, so that the pillar 28 is pressed against the side of the supporting pipe 24 to fix the pillar 28 in a vertical orientation.

Figure 11:
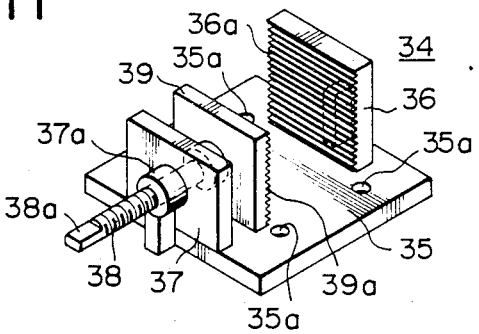
FIG. 11 is a perspective view of a mounting base.

A fixing base 34 for the vibrator is fixed onto the pillar 28 as shown in FIG. 11. This base 34 has a base plate 35 made of a metal sheet which has a plurality of through holes, 35*a*, for receiving bolts for fixing the vibrator. Fixed on a bottom side of the base plate 35 are pairs of supporting plates 36 and 37, in opposed position relative each other. Formed on an inside face of one of the supporting plates are numerous ridges 36*a*, and formed outside of the other plate 37 is a boss collar 37*a* with a screw shaft 38 mated in thread holes formed within the boss 37*a* and the plate 37.

An outer end of the screw shaft 38 has a polygonal pillar body 38*a* and a pressing plate 39 fixed on its inner end. A plurality of ridges 39*a* are provided on the side of supporting plate 39 which faces plate 36.

Figure 6:
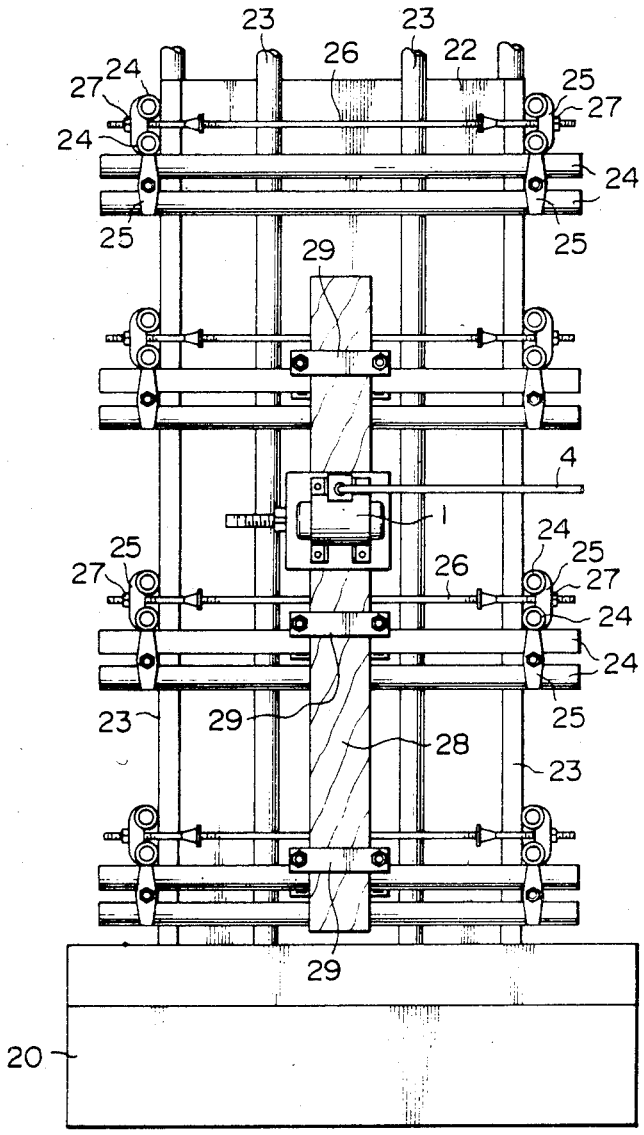
FIG. 6 is a front view showing the vibrator attached to a frame.
Figure 7:
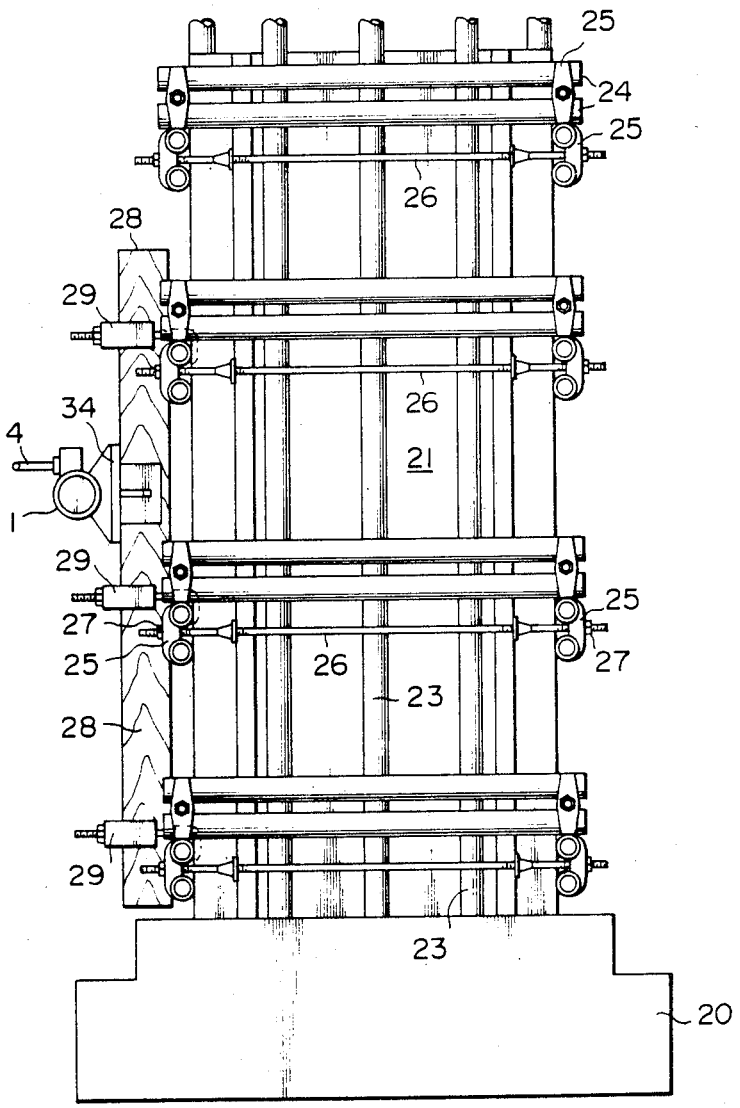
FIG. 7 is a side view showing the arrangement of FIG. 6.
Figure 12:
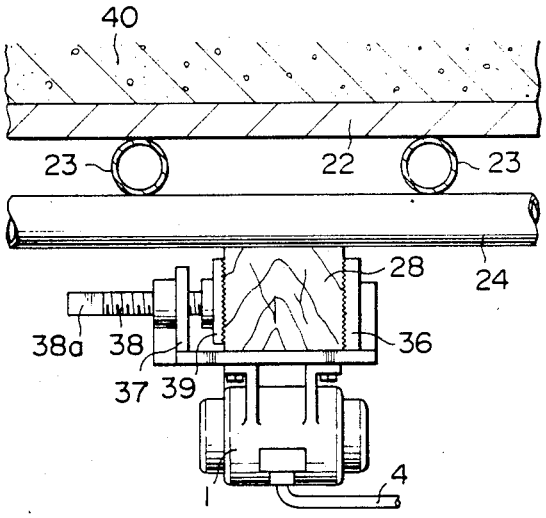
FIG. 12 is a plan view showing the vibrator fixed on the base of FIG. 11.

Thus, fixture base 34, by rotating the screw shaft 38, securely fixes the pillar 28 between the supporting plate 36 and the pressing plate 39, as shown in FIGS. 6 and 12. A crank shaft end (not shown) is mated to the polygonal pillar body 38*a* of the screw shaft 38, and the screw shaft is rotated thereby to advance the pressing plate 39 so that the supporting pillar 28 is firmly held between the supporting plate 36 and the pressing plate 39.

Vibrator 1 is fixed by bolts through holes 35*a* for mating of the base plate 35 of the fixing base 34. In such a manner, the vibrator 1 is fixed outside the frame 21 or 22 and concrete cement materials 40 are paved in a space surrounded by the frames 21 and 22.

Different vibrator frequencies produce different functional phenomenons. They may be classified and described as follows:

(1) Low frequency vibration (e.g., about 3,000 vpm).

The vibration penetrates into the interior of the cement material and vibrates the construction entirely, including the frames 21 and 22, to improve fluidity of the cement, but after a lapse of a long duration, the materials having different weights separate and fall.

(2) Medium frequency vibration (e.g., about 6,000 vpm).

The vibration produces a smooth fluidity of the cement materials, with a lesser separation of the materials than in case (1), supra, and excess water is expeditiously excluded by a separation effect of the finely divided material, thereby improving viscosity of the cement.

(3) High frequency vibration (e.g., greater than about 9,000 vpm).

This short vibration wavelength is reflected by the material comprising the concrete cement. This causes bubbles contained in the material to be exhausted up out of the concrete. Also, the coherence of the concrete increases while there is very little separation of the materials.

Viscosity is also an important factor in determining in accordance with the present invention the vibration to apply to the concrete cement. The viscosity of concrete cement is conventionally expressed in a slump number. The higher the slump number is, the softer the material is; the lower the slump number is, the harder the material is. For example, a slump number of 18 indicates quite soft material, 10 indicates medium, and 7 indicates a hard mixture.

The method of the present invention provides a different vibrational treatment to a particular pouring of concrete based on the slump number for that particular sample of materials. The following examples are representative of the present method for two different slump numbers:

For a slump number of 18, the frequency vibration might be set at about 4,000 vpm for 30 seconds, then at about 6,000 vpm for 30 seconds, and finally at above 9,000 vpm for one minute.

For a slump number of 10, 2 minutes for a low frequency vibration of 4,000 vpm, 2 minutes for a medium frequency vibration of 6,000 vpm, and one minute for a high frequency vibration is one method of vibrational treatment in accordance with the present invention.

Time-breakdown of the vibration frequency changes, in accordance with the slump numbers of the associated concrete samples, achieves a specific teaching of the present invention. The proper packing or tightening of the concrete is achieved in stages, working up from the bottom. From the bottom to about the one-third mark, the present invention teaches to utilize the low vibrational frequency, as selected for that slump number. From the one-third to the two-thirds mark, the medium vibrational frequency is used, as selected for the slump number of the sample. The high vibrational frequency is used for consolidating or packing from the two-thirds mark to the top of the poured concrete.

Thus, the shortest packing time is achieved by selecting, in accordance with the present invention, a certain time/vibration frequency profile or curve for a given slump number sample.

Figure 13:
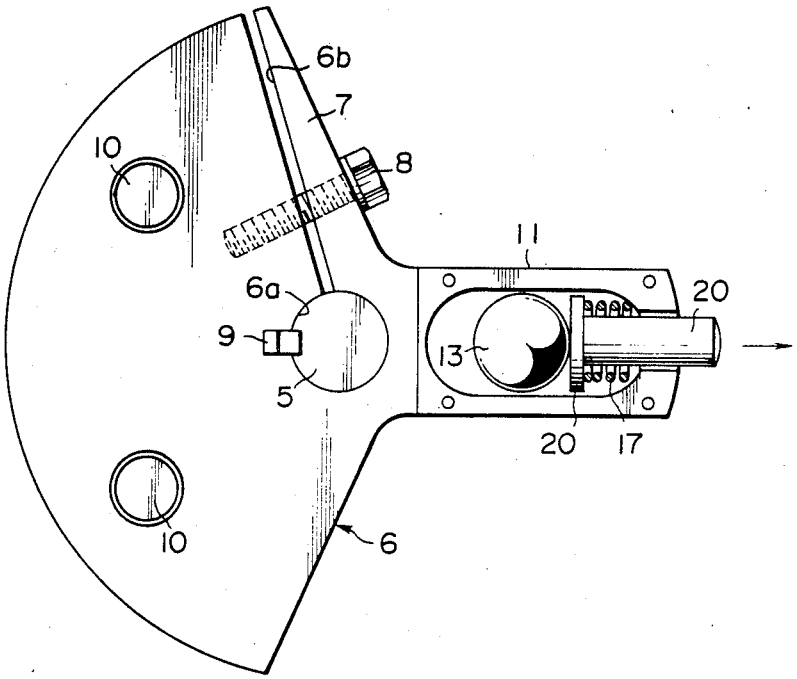
FIG. 13 is a plan view of a modification of the weight balance member.
Figure 14:
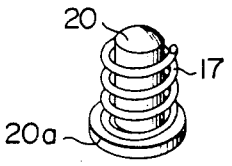
FIG. 14 is a perspective view of a sliding shaft associated with FIG. 13.
Figure 15:
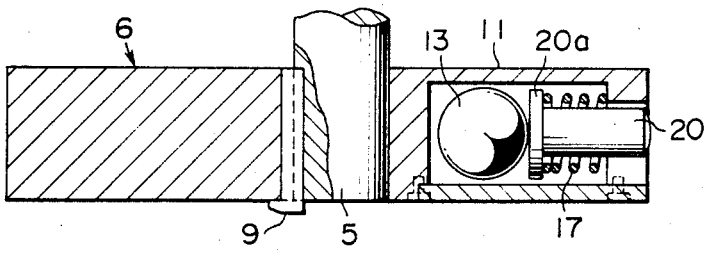
FIG. 15 is a longitudinal side sectional view of the weight member of FIG. 13.

Those skilled in the art will appreciate that many variations and modifications may be made to the foregoing disclosure without departing from the advantages and novel features of the present invention. For example, the double nuts 18 and 19, which are slidably and frictionally mated on projection 11 (see FIG. 2), may be replaced by a slidable shaft 20 with no male threads, as is shown in FIGS. 13–15. Then, spring 17 would be resiliently positioned between disk 20*a* (formed on the inner end of the slidable shaft 20) and the end side of the forward end of projection 11. This alternative design cannot, in this instance, adjust a pressing force against the ball 13 by moving nuts 18 and 19 (as shown and discussed in conjunction with FIG. 2), but it can create a centrifugal force, corresponding to the weight of the slidable shaft 20 and a spring constant of spring 17. Thus, the centrifugal force teaching of the present invention is achieved with a simpler construction than in FIG. 2. All such modifications and variations, which could be implemented by one of ordinary skill in the art, are intended to be included within the scope of the appended claims.

What is claimed is:

1. A method of packing contrete with a vibrator which has a selectable vibrational frequency, comprising the steps of:

ascertaining the slump number of a body of unset concrete which is to be packed;

vibrating the body of unset concrete at a relatively low vibriational frequency in the range of 1500 to 4500 vpm from externally of that body for a first time period in accordance with the ascertained slump number in order to pack a lower region of the body of unset concrete;

then, vibrating the body of unset concrete at a relatively medium vibrational frequency in the range of 4500 to 7500 vpm from externally of that body for a second time period in accordance with the ascertained slump in order to pack a middle region of the body of unset concrete; and finally, vibrating the body of unset concrete at a relatively high vibrational frequency above 7500 vpm from externally of that body for a third time period in accordance with the ascertained slump number in order to pack an upper region of the body of unset concrete, said high vibrational frequency being higher than said medium vibrational frequency, and said medium vibrational frequency being higher than said low vibrational frequency.

2. A method as in claim 1, wherein:

said regions represent approximately equal thirds, by volume, of said concrete sample.

3. A method as in claim 1, wherein:

said time periods vary with the ascertained slump number such that the lower the ascertained slump number, the longer the time periods, and said vibrating frequencies are selected in accordance with the ascertained slump number and the respective selected time period.

* * * * *